United States Patent [19]

Heien

[11] 3,958,426

[45] May 25, 1976

[54] OFFSHORE HARBOR TANK AND INSTALLATION

[76] Inventor: Sigurd Heien, Aslokkveien 82, Billingstad, 1370 Asker, Norway

[22] Filed: Feb. 16, 1972

[21] Appl. No.: 226,684

[30] Foreign Application Priority Data

Mar. 2, 1971 Norway ..... 768/71

[52] U.S. Cl. ..... 61/46; 61/1 R; 61/4; 61/34; 61/46.5; 61/50

[51] Int. Cl.[2] ..... E02D 7/00

[58] Field of Search ..... 61/46, 46.5, 50, 52, 61/49, 48, 1, 34, 4; 114/230, .5 T, .5 D

[56] References Cited

UNITED STATES PATENTS

| | | | |
|---|---|---|---|
| 635,906 | 10/1899 | Wilson | 61/46 |
| 3,369,511 | 2/1968 | German | 61/46 X |
| 3,402,559 | 9/1968 | Fukushima | 61/52 |
| 3,422,628 | 1/1969 | McDonald | 61/46 |
| 3,434,442 | 3/1969 | Manning | 114/.5 T |
| 3,552,131 | 1/1971 | Mott et al. | 61/46 |
| 3,592,155 | 7/1971 | Rosenberg | 114/.5 T |
| 3,618,327 | 11/1971 | Frein et al. | 61/46 |

*Primary Examiner*—Jacob Shapiro
*Attorney, Agent, or Firm*—Young & Thompson

[57] ABSTRACT

An offshore harbor and tank installation for oil and gas, comprising a number of steel or concrete caissons floated separately to selected position and interconnected axially and in floating vertical position interconnected radially to desired configuration, and sunk to the ocean floor, the hollow spaces between the adjacent walls of the caissons may be ballasted with sand, gravel or similar material.

5 Claims, 10 Drawing Figures.

OFFSHORE HARBOR TANK AND INSTALLATION

The invention relates to an offshore harbour and tank installation for oil and gas, comprising a number of steel or concrete containers, which are placed interconnected on the ocean floor.

In the exploitation of oil or gas finds below the ocean floor, the landing of the products is often a problem. Long underwater pipe lines must, when it concerns oil, often be equipped with pumping stations, in case the pipe line is to have reasonable dimensions. The pipe lines may, furthermore, be subjected to breakage and become the cause of embarrassing oil leakages. Over long distances it may therefore be more economical and safer against oil pollution, to make use of transport by ship. If however, such transport is to be efficient, there must, on oil fields in the open sea, be provided sufficient storage facilities and reliable loading devices for tankers.

The object of the invention is therefore to provide a harbour and tank installation of the said type, which is semimobile in that the containers are prefabricated and floated to the selected position where they are interconnected and sunk to stand on the bottom and may later be disconnected and floated to another position, which installation also may be used as a drilling installation.

This is according to the invention achieved in that the containers consist of cylindrical, hollow sections of reinforced concrete or steel in the form of caissons which in floating position are interconnected axially to the desired length and in floating vertical position are interconnected radially to form a desired pattern with desired mutual distance.

Preferably the containers have such a length that standing on the ocean floor the upper end extends well above the sea surface to form breakwater, in a ring or polygon pattern.

On that side of the harbour installation where the wave activity is the least, a suitable ship entrance is located. In order to obtain a solid, continuous ring breakwater, the breakwater heads at the ship entrance are, according to the invention, reinforced by extra caissons, which bear against and are connected to a submerged threshold in the entrance.

If the breakwater installation is given a circular form and the inlet is placed on the lee side, this will reduce the wave activity in the basin and facilitates the loading of ships even in heavy sea. The above mentioned installation also makes it possible to serve larger ships, anchored downwind on the outside of the breakwater installation.

The caissons shall, according to the invention, be placed on the ocean floor in a certain, mutual distance, i.e. from 1 to 2 meters, and shall be interconnected in the upper edge by means of perforated bracing walls with adjoining deck plates. Walls and deck plates may be poured in situ, or, preferably, should be prefabricated on shore and installed and post-tensioned between the caissons by means of steel cables.

The perforated walls may stand vertically, or be inclined in relation to the caissons. These will, together with the curved exterior walls of the caissons, reduce the impact effect of the wave rolling against the construction, as well as the wave activity in the harbour basin.

Caissons of reinforced concrete may be cast by means of sliding forms installed on a slipway, or on a floating pontoon device. Should it become necessary to connect two or more sections, this may be done by means of steel cables through holes in the end plates of the cylindrical sections. The sections of the caissons are floating on their cylindrical surfaces while being coupled, such that the vertical end walls may be adjoined. The joints are grouted in order to obtain the strength and corrosion protection required.

After being assembled, the caissons are floated to the construction site and are installed in place by being filled with water. Accurate placement may, in heavy sea, present certain difficulties, but by first building the breakwater heads and subsequently continuing the installation away from these by means of anchorages, the caissons will in turn brace each other and in the end form an interconnected unit.

As is already mentioned, the caissons are put together from cylindrical sections, which will serve as containers for oil or refrigerated gas. The sections may communicate by means of pipe lines, such that filling and emptying may be regulated as required. The oil may rest on the underlying water in the tank and the pipe line system may be so designed, that when oil runs in, the water runs out, and vice versa.

Oil from wells in the field may be carried to the harbour installation in pipe lines, and from here be carried to tankers for transport to a refinery on shore. Refrigerated gas may be collected in special steel containers placed in the caissons. The transport of the gas to the consumer locations must take place by means of specially designed vessels.

A harbour installation of the type outlined may, if desired, be moved to other locations with corresponding depths and bottom conditions. In case, the perforated bracing walls and the top plates above these must be released by removing the attaching means on the inside of the caissons walls. By means of pumps, water may be emptied from the caissons, such that these float to the surface, and may subsequently be floated to new locations for reinstallation. In such cases, it may be necessary to replace the bracing arrangements, fully or in part.

Preferably the container sections are connected by means of steel cables passed through prefabricated holes in the top and bottom end plates of the containers. Sealing arrangements are placed along the outer surface of the cables and the space between these and the end walls is grouted in order to obtain the necessary strength and corrosion protection.

In a preferable embodiment each tank or caisson will be assembled from three sections and will consequently have three separate chambers. The end walls of the sections are, however, provided with communicating openings, which, prior to the launching are sealed by means of steel plates, screwed or locked to frames embedded in the end walls. The communicating openings may be utilized for the passage of pipe arrangements, but must, during the placement of the caissons on the ocean floor, be provided with adjustable valves in consideration of the separate water filling of each chamber.

The caissons are transported over the sea in the horizontal position and are at the installation site turned on end by filling two interconnected chambers by water, and letting the tank float on the upper chamber. When placing the caisson on the ocean floor, the water inlet for the upper chamber is also opened and the tank will sink to the bottom and remain standing.

In order to obtain a tank installation of sufficient capacity, it is necessary to interconnect several caissons. In the present case the installation comprises seven units, in that six of said units are coupled to form an enclosed circle surrounding the one in the center.

Since the caissons must be coupled together in the open sea, the coupling arrangement must be both quick and elastic. This is achieved, according to the invention, by placing a cylinder or special ball joint in the contact point between the upper edge of the cylindrical caissons, and securing the joints by means of flexible steel cables. The coupling arrangement must be able to sustain tensile, compressive and shear forces which may arise as a result of wave activity. It must also be possible to remove the coupling, in case the tank installation is to be moved or diassembled.

The caissons are placed at a spacing of 1.5 to 2 meters, and in order to dampen wave activity between these, the upper caisson sections are provided with vertical ribs, which in a horizontal plane form pockets with alternating narrows and bays to dampen the wave activity.

The oil lines from the production platforms to the tank installation are connected to the internal plumbing of same, such that when oil is taken in, water escapes and vice versa. The oil may be transmitted to ships via pipe lines secured to pivotable cantilevers from the upper deck of the tank installation. If the ships are anchored broadside to the installation, they may be moored with hawsers to the installation and be kept at a prudent distance by means of fenders which may be lowered and which bear against the caissons.

Caissons may be placed on the outside of the interconnected central core. These containers are connected to the installation as described above, filled with water, and may in easy weather be utilized as a pier installation for direct berthing. Also in this case, the tank installation must, however, be provided with prudent fendering arrangements.

Some embodiments of the invention will be described below with reference to the drawings, wherein.

Figure 1:
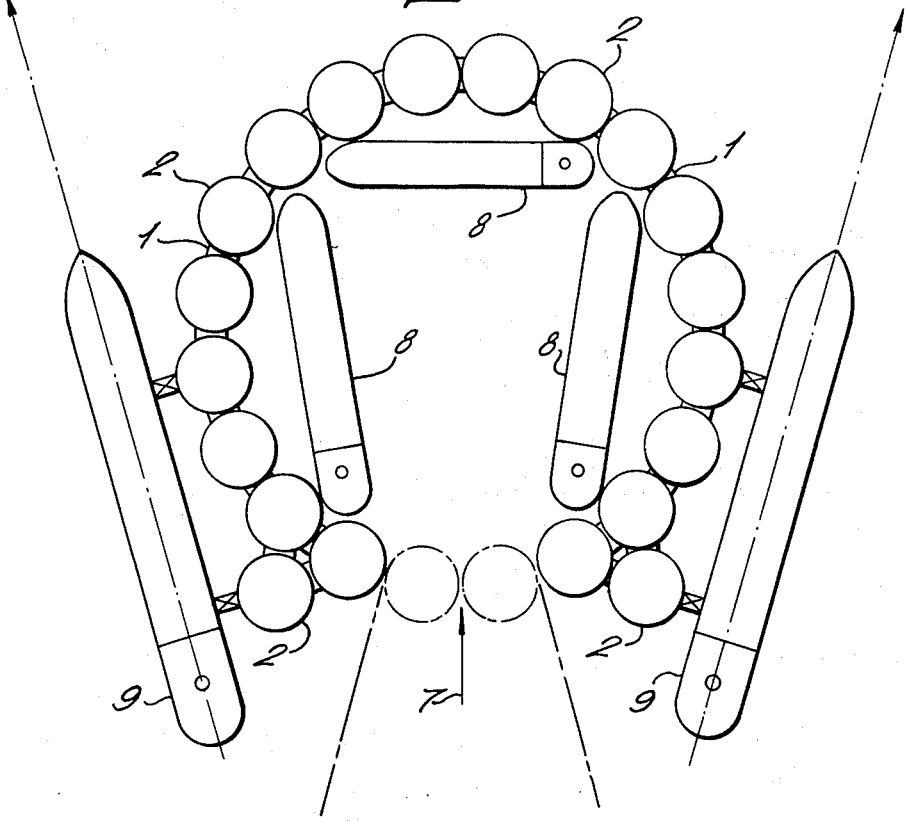
FIG. 1 shows a plan view of a circular harbour installation according to the invention.
Figure 2:
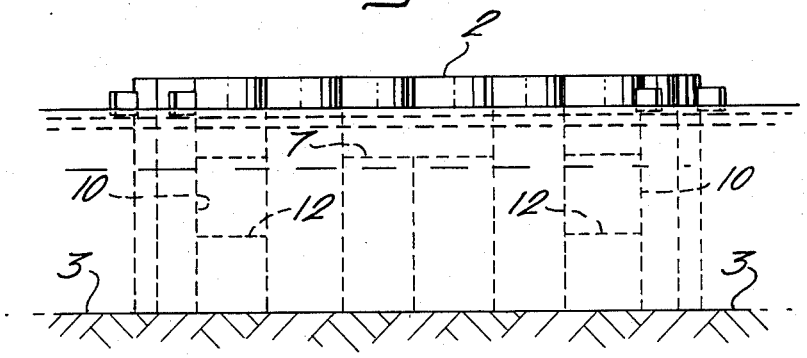
FIG. 2 shows the harbour from the entrance side.
Figure 3:
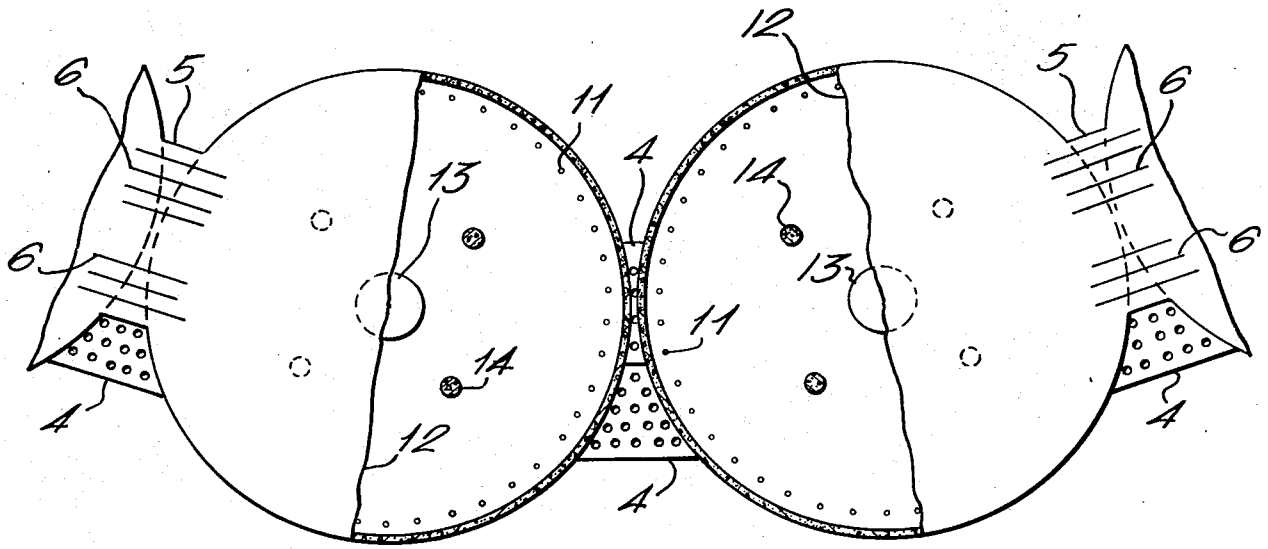
FIG. 3 shows the cylindrical caissons with top and bottom plates as well as bracing arrangements.
Figure 4:
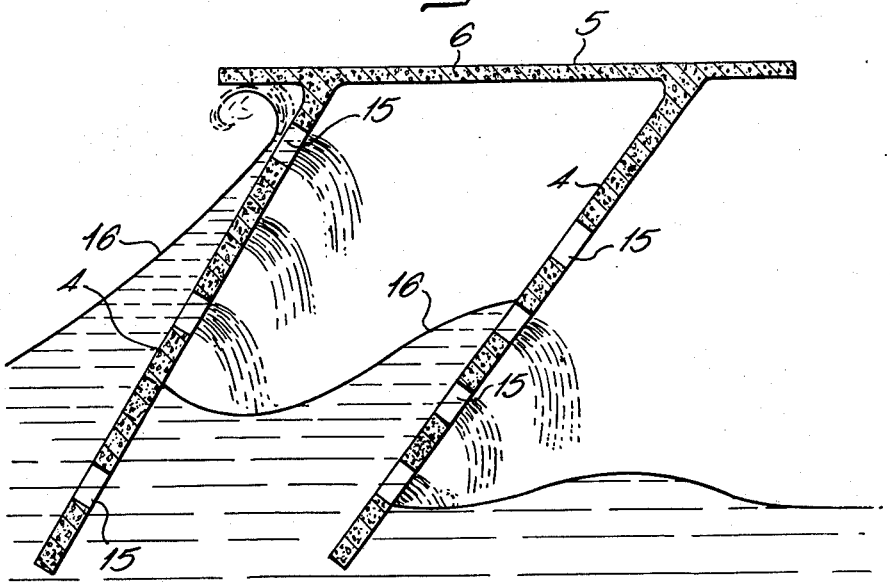
FIG. 4 shows a section through the perforated bracing walls with deck plates.

The harbour installation in FIGS. 1 to 4 consist in the present version of the circular breakwater 1, comprising the cylindrical caissons 2, placed on the ocean bottom 3, mutually interconnected by the perforated bracing walls 4 and the deck plates 5, and by means of the steel cables 6.

The harbour installation has the entrance 7 and may on the inside of the breakwater load one or more ships 8, and on the outside, one or more ships 9, anchored downwind in the dominant wave direction.

The caissons may be made of sections 10 coupled together by means of the steel cables 11, running through holes in the end walls 12. The sections may, in the end walls, have openings 13 for communicating, or be interconnected by means of pipe lines passing through the cover plates of the openings. Top and bottom in the caisson sections are braced by means of the columns 14, which at the same time may serve as a climbing device for the slide forms, in case the caissons are cast on a slipway.

The bracing walls 4, which by means of the steel cables 6 are fixedly installed and post-tensioned between the upper part of the caissons, have perforations 15 to dampen the impact forces from the waves 16.

The harbour installation in FIGS. 1 to 4 performs as follows:

The interconnected caissons 2 form the ring breakwater 1 around the harbour installation. The assembly is so oriented in relation to the dominant wave direction that the entrance 7 is as far in the lee as possible. The breakwater heads are strengthened by means of extra caissons and are connected to the submerged threshold under the entrance.

Between the caissons are placed bracing walls 4 with perforations 15, which together with the curved exterior walls of the caissons and the circular breakwater installation reduce the impact effects of wave motion and the wave activity in the harbour installation. The caissons in the breakwater are, at the same time, storage tanks for oil and, eventually refrigerated gas.

The oil in the caissons rests upon the underlying water, which, because of the communication of this water with the water outside of the caissons, will automatically go down when oil is introduced, and rise when oil is withdrawn. The oil tanks are mutually interconnected by means of pipe lines, which may be opened or closed by means of valves. For the movement of the oil, pumping may be required. Water, on the other hand, may freely run in or out through adjustable openings at the bottom of the tanks.

Smaller ships may load oil and refrigerated gas in the harbour installation itself, while larger ships may load while anchored downwind on the outside of the breakwater.

The tank installation according to FIGS. 5 to 10 consists of circular caissons or containers assembled from the sections 17, by means of the cables 18 through holes in the end walls 19, provided with sealing devices 20, which facilitate grouting of the connection joint 21 between the sections. The communicating openings between the sections are indicated by 22, the sealing plates by 23 and by 24, the internal column arrangement which braces the end walls 19, and the top plate by 25.

Figure 5:
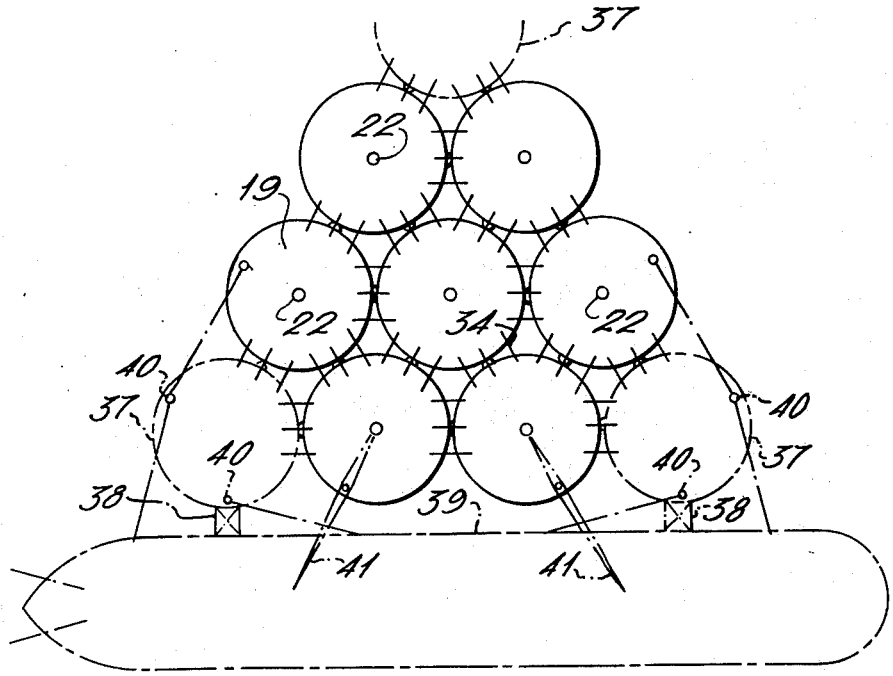
FIG. 5 shows a plan view of another installation according to the invention.
Figure 6:
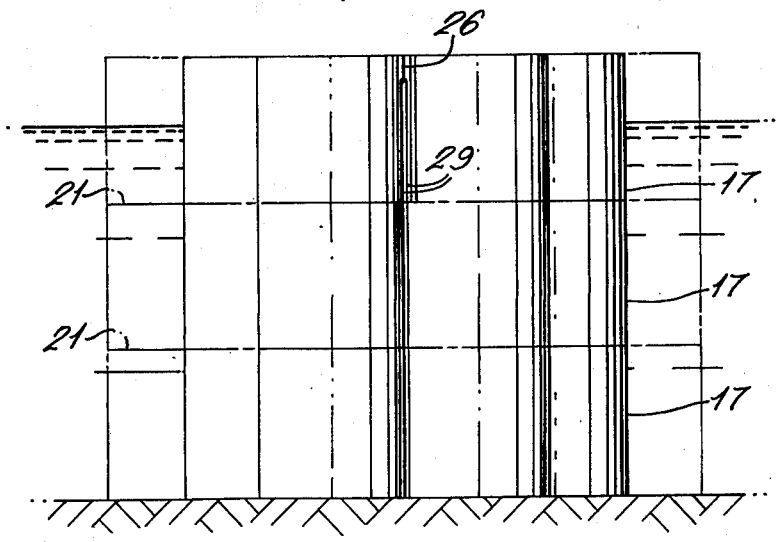
FIG. 6 shows the installation in place on the ocean floor.
Figure 7:
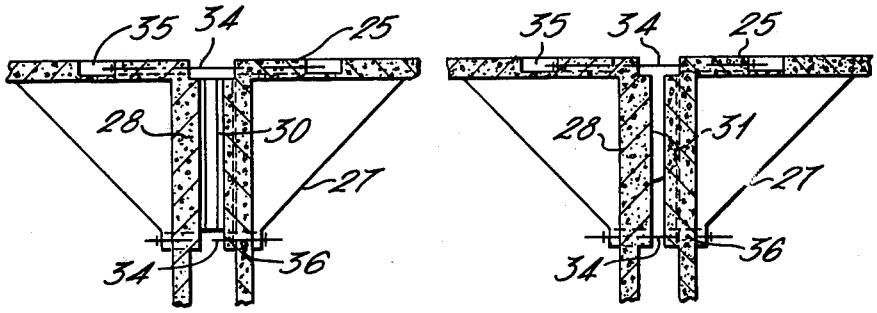
FIG. 7 is a front view of the interconnection devices.
Figure 10:
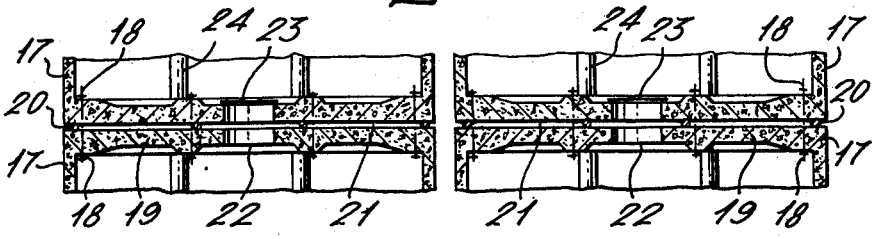
FIG. 10 shows the interconnection of the end walls of the caisson sections.
Figure 8:
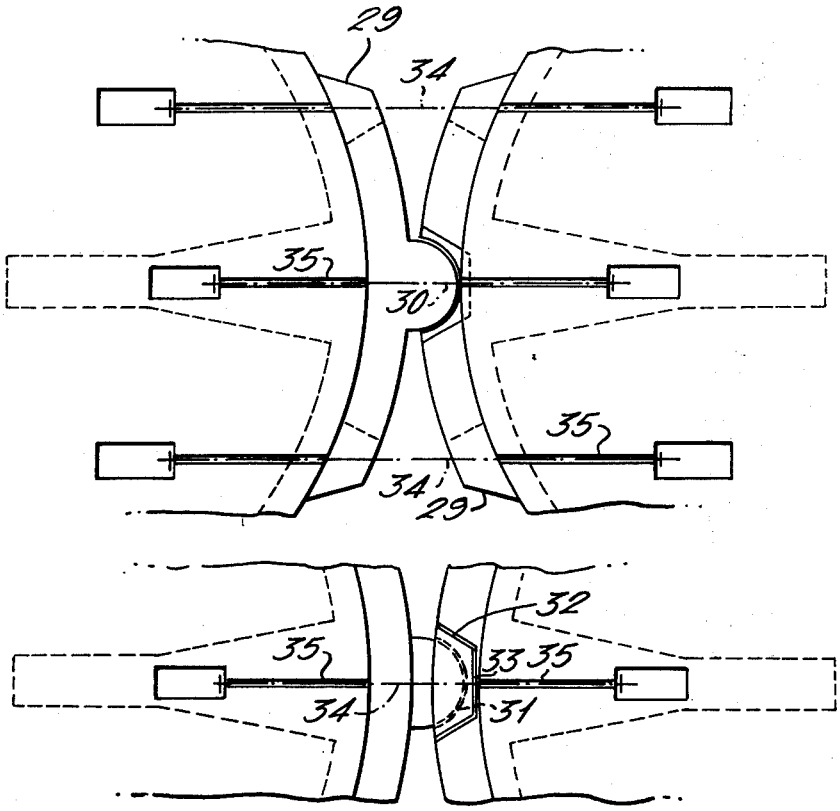
FIG. 8 shows a plan view of the interconnection devices.
Figure 9:
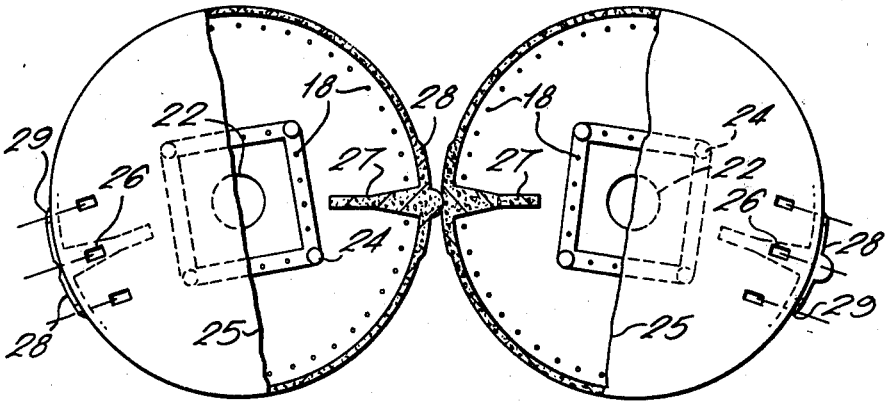
FIG. 9 shows a plan view and a section of two of the caissons, with the bracing of the connection points in the upper edge of the containers.

Preferably the caissons are arranged in such a configuration on the ocean floor, in relation to the usual direction of wave motion in the sea, that a minimum of wave energy is transferred into the installation, for instance as shown in FIG. 5, wherein one or more extra caissons 37 may be added to the original configuration of seven caissons, so that the extra caisson or caissons 37 is pointing against the wave front and splitting it. The configuration of a triangle as indicated in FIG. 5, will then satisfy the said intention for three usual wave directions.

The connecting device 26 is secured to the deck plate 25 through the bracing wall 27 and the strengthened wall section 28, as well as the vertical ribs 29 on the outside of the upper section of the caisson.

The connecting device 27 comprises either the cylinder joint 30, the parts embedded in the upper edge of the caisson, or the ball joint 31, where the socket part 32 is movable vertically in the guide slot 33.

The movable joint device 27 may be locked at the upper- and lower edge, both, by means of the cables 34, which lie in the recesses 35 in the top plates and the recesses 36 in the strengthened section of the caisson wall. The special caissons 37, protected by the fendering devices 38, may be utilized for berthing of ships 39 anchored at the tank installation, or in easy weather moored to the pullers 40, which are embedded in the deck plates of the caissons. The ships may bear against elastic pontoon fenders 38 and take on oil through hose connections attached to pivotable derricks 41.

The purpose of the tank installation is storage of and delivery of oil to ships in the open sea. Oil is transferred to the installation through pipe lines from drilling platforms or production platforms in the oil field. The pipe lines are connected to the distribution system of the installation, which admits the oil at the upper end of the caissons.

The caissons have outlet openings at the bottom through pipes, which may be regulated and end at an elevation above the sea level, which give the tanks maximum storage capacity. The oil which is taken in, floats on the underlying water. When oil is admitted, water is displaced. When oil is removed, water flows into the tank.

Ships for loading may anchor at the tank installation and take on oil through flexible pipe lines on pontoons or they may in easy weather moor against the caisson by means of floating fenders and take on oil through pipe arrangements attached to adjustable derrick devices, placed on the tank installation deck slabs.

The tank installation must be well lighted, have a radio station and radar, as well as other navigational equipment for the control of ship traffic. If helicopters are utilized for quick connection with the shore, these may land on the deck of the caissons.

Having described my invention, I claim:

1. An offshore harbor and tank installation for oil and gas, comprising a plurality of closed containers comprising cylindrical hollow sections in the form of caissons having end walls, means detachably interconnecting said caissons in axially aligned relationship, means detachably interconnecting a plurality of axially aligned series of caissons in upright side-by-side relationship, and means ballasting said axially aligned series of caissons so that they rest on the sea floor and extend well above the surface of the sea, the upper sections of the caissons being removed in a limited area of the breakwater in order to make room for a ship entrance, the breakwater heads at the entrance being strengthened by means of extra caissons which rest against and are connected to a submerged threshold in the entrance.

2. An installation according to claim 1, wherein the circular end walls of the caisson sections are provided with communication openings, such that the sections in the coupled position become part of cylindrical containers, which are both storage tanks for oil and a building element in a breakwater construction.

3. An installation according to claim 2, wherein the container sections are connected by means of steel cables through prefabricated holes in the flat end walls of the sections, provided with sealing devices for grouting, and that the assembled caissons in their upper edge have embedded cylindrical or ball joints, movable in the horizontal and vertical direction both, and that these joints are locked in the upper and lower edge, both, by means of cables, such that the outer caissons, standing on the ocean floor, form a continuous, closed ring, connected to the caisson in the center.

4. An installation according to claim 3, wherein the upper sections of the caissons are provided with external, vertical ribs, and that these together with the walls of the caissons form a water passage, in a horizontal plane, which with its alternating restrictions and widenings have a damping effect on the wave activity.

5. An installation according to claim 4, where cylindrical caissons are connected by means of cables via cylinder or ball joints, characterized in that the ball joint is movable in the vertical plane, in that the socket shaped part may be displaced in a groove, the direction of the axis of which is parallel to the vertical axis of the caisson.

* * * * *